US006334723B1

(12) United States Patent
Trovinger et al.

(10) Patent No.: US 6,334,723 B1
(45) Date of Patent: Jan. 1, 2002

(54) PRINT MEDIUM FEED SYSTEM USING PRE-EXISTING PRINTING APPARATUS

(75) Inventors: Steven W. Trovinger; Joseph S. Wong, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/387,623

(22) Filed: Aug. 31, 1999

Related U.S. Application Data

(62) Division of application No. 09/205,863, filed on Dec. 4, 1998, now Pat. No. 5,997,197, which is a division of application No. 08/979,391, filed on Nov. 28, 1997, now Pat. No. 5,913,625.

(51) Int. Cl.[7] ..... B41J 11/26; B65H 7/02

(52) U.S. Cl. ..... 400/611; 400/708; 271/258.05

(58) Field of Search ..... 400/605, 608.1, 400/608.3, 611, 624, 613.1, 619, 634, 642, 693, 708; 271/259, 261, 262, 263, 258.01, 258.02, 258.04, 258.05

(56) References Cited

U.S. PATENT DOCUMENTS

| | | | | | |
|---|---|---|---|---|---|
| 4,234,261 | A | * | 11/1980 | Hendrischk et al. | 400/608.3 |
| 4,509,734 | A | * | 4/1985 | Rutishauser | 400/625 |
| 5,037,016 | A | * | 8/1991 | Wingerter | 400/605 |
| 5,152,623 | A | * | 10/1992 | Yamada et al. | 400/605 |
| 5,336,003 | A | * | 8/1994 | Nagashima | 400/708 |
| 5,466,079 | A | * | 11/1995 | Quintana | 400/708 |
| 5,486,063 | A | * | 1/1996 | Fox et al. | 400/708 |
| 5,564,848 | A | * | 10/1996 | Quintana | 400/708 |
| 5,570,962 | A | * | 11/1996 | Suzuki et al. | 400/693 |
| 5,580,046 | A | * | 12/1996 | Beaufort et al. | 271/258.02 |
| 5,613,790 | A | * | 3/1997 | Miazga | 400/708 |
| 5,615,876 | A | * | 4/1997 | Yergensum et al. | 271/258.05 |
| 5,640,903 | A | * | 6/1997 | Salomon | 400/630 |
| 5,671,466 | A | * | 9/1997 | Hokamura et al. | 271/258.03 |
| 5,755,521 | A | * | 5/1998 | Ito et al. | 400/605 |
| 5,800,083 | A | * | 9/1998 | Gaarder et al. | 400/624 |
| 5,913,625 | A | * | 6/1999 | Trovinger et al. | 400/624 |
| 5,957,446 | A | * | 9/1999 | Takanuma | 271/258.01 |
| 5,964,460 | A | * | 10/1999 | Azumi et al. | 271/258.05 |

FOREIGN PATENT DOCUMENTS

| | | | | |
|---|---|---|---|---|
| EP | 0428163 A2 | * | 5/1991 | 400/605 |
| EP | 0099977 | * | 2/1994 | 400/605 |
| JP | 0142878 | * | 8/1983 | 400/605 |
| JP | 0192576 | * | 8/1986 | 400/605 |
| JP | 36-3286375 | * | 11/1988 | 400/605 |
| JP | 40-6191107 | * | 7/1994 | 400/605 |

* cited by examiner

*Primary Examiner*—Eugene Eickholt

(57) ABSTRACT

The invention accomplishes print medium feed functions, at least in part, by making use of pre-existing printer apparatus that is used to accomplish other functions of the printer. For example, the invention can enable the use-of a single print drive mechanism to accommodate multiple print medium feed paths within a printer and, in particular, feed paths in which print media are fed into the print drive mechanism in different (e.g., opposite) directions. Additionally, the invention can enable a rotatable media guide that can be positioned in one position to guide a sheet of a print medium during a print operation and in another position to release the sheet of the print medium after the printing operation, to be positioned in still another position to facilitate guiding a sheet of a print medium into a print drive mechanism after the sheet has traversed a gap in the feed path. The invention can also enable sensing of print medium insertion into a print medium feed path using pre-existing sensing apparatus within a printer that is used for other sensing purposes.

32 Claims, 9 Drawing Sheets

PRINT MEDIUM FEED SYSTEM USING PRE-EXISTING PRINTING APPARATUS

CROSS REFERENCE TO RELATED APPLICATION(S)

This is a divisional of application Ser. No. 09/205,863 filed on Dec. 4, 1998 now U.S. Pat. No. 5,997,197. Which is a DIVISIONAL of application Ser. No. 08/979,391 filed Nov. 28, 1997, now U.S. Pat. No. 5,913,625 issued Jun. 22, 1999.

BACKGROUND OF THE INVENTION

1. Field of the Invention

This invention relates to feeding a print medium into a printer and to guiding a print medium through a path in a printer.

2. Related Art

Many printers provide multiple operational modes in which a print medium (e.g., paper, plastic transparency) is fed into a print drive mechanism used to advance the print medium through a printing zone of the printer during printing. For example, the standard mode of operation of many desktop printers is an automatic multi-sheet feeding mode in which individual sheets from a stack of print media (held in, for example, a tray) are, upon appropriate electronic control (e.g., computer control), automatically picked from the stack by a pick mechanism and fed into the print drive mechanism. Many of those printers also include a secondary mode of operation, usually intended for occasional and/or specialized use. The secondary operational mode is often a single sheet mode in which a single sheet of a print medium is fed (often manually) into the print drive mechanism. The secondary operational mode is sometimes a mode in which a small number of sheets of print media are placed in a feed tray, and automatically picked and fed to a print drive mechanism.

Generally, in printers that include a secondary mode of operation in addition to a standard mode of operation, a print medium is fed into the print drive mechanism during the secondary operational mode in the same direction as that in which a print medium is fed during the standard operational mode. For example, in some printers, single sheet mode consists of nothing more than placing a single sheet of a print medium on a stack of print media used in an automatic multi-sheet feeding mode so that the added single sheet is the next sheet picked and fed into the print zone. Even in printers in which a print medium is initially fed into a physically separate loading slot during the secondary operational mode, the print medium is usually eventually directed into the print drive mechanism through the same feed path (i.e., in the same direction) as used during the standard operational mode.

Physical constraints may preclude location of a loading slot for a secondary operational mode so that the feed path for the standard operational mode can be used. For example, a printer designed to be operated within a small area or volume (i.e., a printer having a small form factor) may be restricted so that a user can only access the front of the printer, necessitating that a loading slot for manually feeding a print medium be placed at the front of the printer. If the printer is also designed so that, in the standard operational mode, sheets of print media are fed in a direction from the back of the printer to the front, it becomes, at best, impractical to feed a sheet from the manual feed loading slot into the print drive mechanism in the same direction as that in which sheets are fed during the standard operational mode.

In an inkjet printer, feeding a sheet of a print medium into a print drive mechanism of the printer in a direction opposite that in which sheets are fed into the print drive mechanism during standard operation can be problematic because, just prior to being fed into the print drive mechanism, the sheet must traverse the area (swath gap) through which the print cartridge(s) pass during printing. Since the sheet, which is typically thin and flexible, is not supported in this area, it can be difficult to ensure that the sheet is properly fed into the print drive mechanism. Similar problems (e.g., the necessity for a sheet of a print medium to traverse a gap in the feed path) can exist in other types of printers when a sheet of a print medium is fed into the print drive mechanism in other than the normal feed direction.

One inkjet printer enables a sheet of a print medium to be fed into a print drive mechanism of the printer in a direction opposite that in which sheets are fed into the print drive mechanism during a standard operational mode by providing a sheet feed drive mechanism for such sheet. The sheet feed drive mechanism is positioned opposite the print cartridge swath gap from the print drive mechanism. In a secondary operational mode, a sheet of a print medium is fed into the sheet feed drive mechanism which acts to guide and support the sheet as the sheet traverses the print cartridge swath gap. However, the addition of another drive mechanism significantly increases the cost and complexity of the printer. The additional drive mechanism also necessitates additional space so that the printer is larger than desirable. Additionally, in this printer, a user must effect a special control instruction to cause the sheet feed drive mechanism to operate to feed a sheet of a print medium; the user cannot simply insert the sheet in the feed path. Further, it may not be possible or desirable to feed a sheet of a print medium back through the additional drive mechanism immediately after printing on the sheet, since the ink on the sheet may not be dry. (This problem can be overcome by, for example, pausing during printing to let the ink dry before feeding the sheet through the additional drive roller, or by guiding the sheet through a different exit path using additional structure provided in the printer; neither solution is desirable.) Thus, a better solution is needed for situations in which it is necessary or desirable to provide a second, distinct feed path to a print drive mechanism in addition a first feed path, and, in particular, situations in which such a second feed path is positioned so that a print medium fed therethrough is fed into the print drive mechanism in a direction opposite that in which print media are fed into the print drive mechanism through the first feed path.

In a mode of operation in which a sheet of a print medium is manually fed into a printer, it is often necessary to detect the insertion of a sheet into the print medium feed path associated with that mode of operation. This is typically done by adding an electronic sensor, either an interrupter-type sensor or a reflective-type sensor, that is dedicated to the task of print medium insertion detection. The additional electronics add to the cost and complexity of the printer. An alternative solution to such print medium insertion detection that is more inexpensive and simple is desirable.

SUMMARY OF THE INVENTION

The invention accomplishes print medium feed functions, at least in part, by making use of pre-existing printer apparatus that is used to accomplish other functions of the printer. For example, the invention can enable the use of a single print drive mechanism to accommodate multiple print medium feed paths within a printer and, in particular, feed paths through which print media are fed into the print drive mechanism in different (e.g., opposite) directions. Additionally, the invention can enable a rotatable media guide that can be positioned in one position to guide a sheet of a print medium during a print operation and in another position to release the sheet of the print medium after the printing operation, to be positioned in still another position to facilitate guiding a sheet of a print medium into a print drive mechanism after the sheet has traversed a gap in the feed path. The invention can also enable sensing of print medium insertion into a print medium feed path using pre-existing sensing apparatus within a printer that is used for other sensing purposes.

In a printer having two completely distinct feed paths to a single print drive mechanism, the invention can enable a sheet of a print medium to be guided to the print drive mechanism via at least one of the feed paths without using a drive mechanism, such as the sheet feed drive mechanism of the printer described above. For example, one of the feed paths of the printer can be one in which a print medium is manually introduced into the feed path, while the other feed path can be one in which a print medium is automatically introduced into the feed path. In particular, the feed paths can enable print media to be fed to the print drive mechanism in opposite directions. The invention can enable, if necessary, a sheet of a print medium fed through a feed path that does not contain a drive mechanism to traverse a gap in the feed path in which the sheet is unsupported. In particular, the invention can enable the sheet to traverse such a gap that is proximate to the print drive mechanism, while maintaining adequate guidance of the sheet to ensure that the sheet is directed into a nip region of the print drive mechanism. As explained further below, the invention can enable such sheet feeding to be accomplished with one or more simple and inexpensive mechanisms that necessitate the addition of little or no additional space to a printer in which the invention is used.

To enable a print medium to traverse a gap in a path (which can be, in general, any path) in a printer, the invention can make use of a guiding mechanism positioned on a first side of the gap past which the print medium travels to begin traversing the gap, as well as a print medium receiving mechanism positioned on a second side of the gap to which the print medium travels to finish traversing the gap. The former can be a guide surface for bending the print medium prior to crossing the gap. The latter can be a media guide having a media contact surface which slopes downward, relative to the path, from a first location to a second location that is near the first side of the gap than the first location. The latter can also be a movable media guide that can be placed in a specified position to facilitate directing the print medium along the path. The invention can enable gaps of greater than 0.25 inches to be traversed.

As indicated above, the invention can enable a movable (e.g., rotatable) media guide proximate to a print drive mechanism to be moved to a first position when the print drive mechanism is operated to advance a print medium over the media guide through the print zone during a printing operation, and to a second position when a print medium is being fed over the media guide into the print drive mechanism. The first position is specified to maintain a desired spacing within the print zone between the print medium and an apparatus for printing on the print medium, while the second position is specified to facilitate directing the leading edge of a print medium into the print drive mechanism. Typically the second position is a position at which the media guide has been moved such that a media contact surface of the media guide is lower, relative to a feed path into the print drive mechanism, than at the first position. For example, the second position can be a position at which the media guide has been rotated through an angle of about 18° to the lower position.

As mentioned above, the invention can also enable sensing of the insertion of a print medium into a feed path by making use of a sensor that is adapted to perform a sensing function other than sensing insertion of a print medium into the feed path. The invention can accomplish this by activating a sensor that senses the presence of an object in a space outside of the print medium path, and causing the introduction of an object into that space in response to insertion of a medium into the feed path. The latter function can be accomplished by disposing an object in the feed path so that a print medium inserted into the feed path will contact the object, then transmitting a signal, either mechanically or electrically, in response to contact in the feed path to cause the object to be moved into the space being monitored by the sensor. The sensor can be, for example, a sensor that is positioned on the print carriage of the printer to enable detection of the leading edge of a print medium during a printing operation. Since an existing sensor is used, print medium insertion detection is accomplished in a more inexpensive and a simpler fashion.

When print medium insertion is detected, as described above, by disposing an object in the feed path so that a print medium inserted into the feed path will contact the object, the invention can further provide compliant support of the object so that when a print medium is removed from the feed path after having been inserted, the object can move in response to a force exerted by the print medium, thereby preventing buildup of force between the object and the print medium that may result in marking or scarring of the print medium.

BRIEF DESCRIPTION OF THE DRAWINGS

FIG. 7A illustrates the sensing system when insertion of a sheet of a print medium has not been sensed, while FIG. 7B illustrates the sensing system when insertion of a sheet of a print medium has been sensed.

FIG. 9A illustrates the trigger structure when insertion of a sheet of a print medium has not been sensed. FIG. 9B illustrates the operation of a mechanism for avoiding self-locking of the trigger structure when a sheet of a print medium is removed from the secondary feed path.

DETAILED DESCRIPTION OF THE INVENTION

Figure 1:
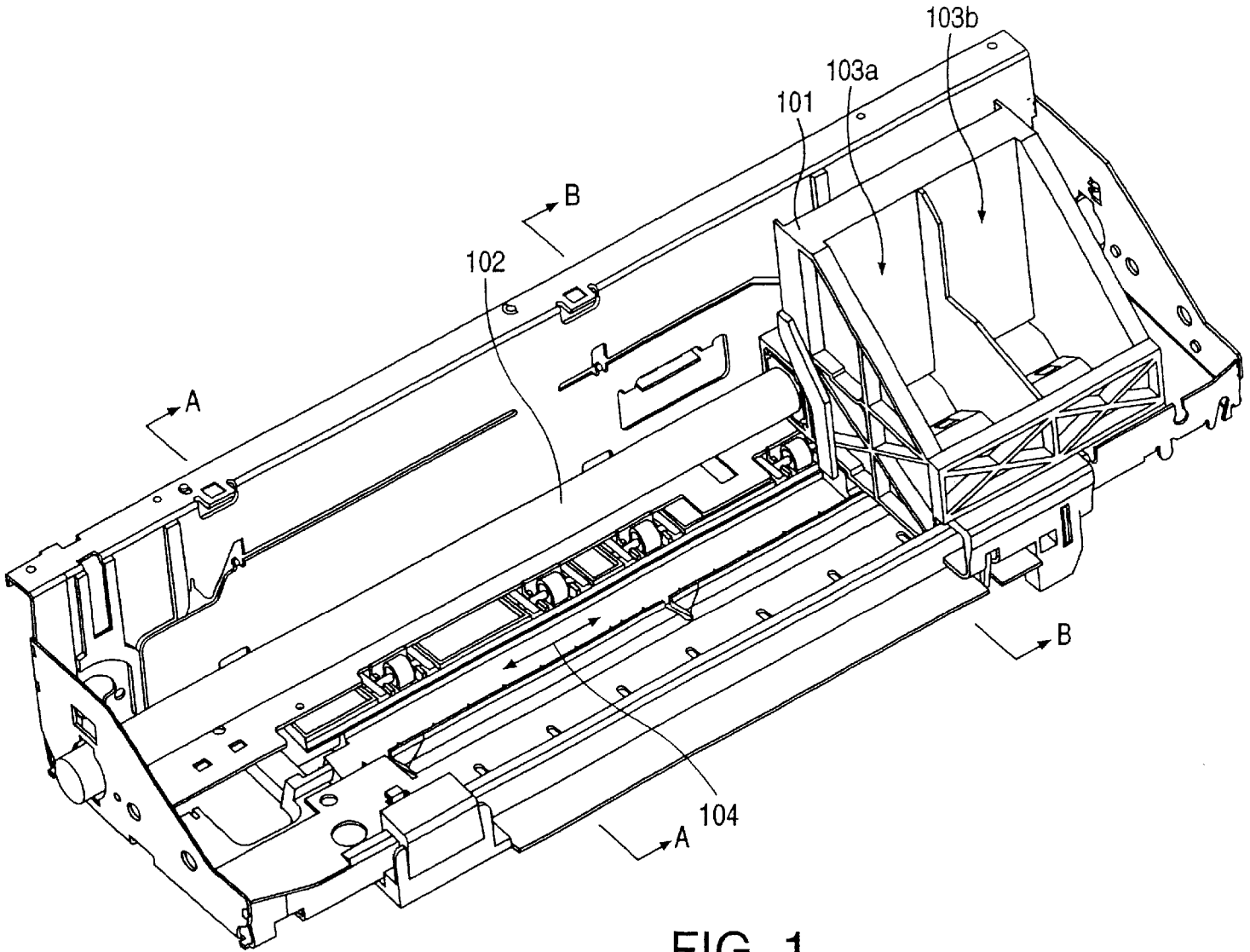
FIG. 1 is a perspective view of apparatus including a print drive mechanism, structure defining print medium feed paths, and a print carriage assembly of an inkjet printer, viewed from above the apparatus, illustrating structure according to the invention.

FIG. 1 is a perspective view of apparatus including a print drive mechanism, structure defining print medium feed paths, and a print carriage assembly of an inkjet printer, viewed from above the apparatus, illustrating structure according to the invention. It is to be understood that, generally, the invention can be used with printing devices other than dedicated printers (e.g., facsimile machines or multifunction machines that include the capacity to print, transmit facsimiles and/or produce copies) and that printing devices with which the invention can be used may accomplish printing using other than inkjet technology (e.g., bubblejet or laser technology). It is also to be understood that the invention can be implemented with and by structures other than the particular structures shown in FIG. 1 (and the other drawings of the application).

In the apparatus shown in FIG. 1, a print carriage 101 is mounted on a slider rod 102 so that the print carriage 101 can move along the slider rod 102 and does not rotate about the slider rod 102. As illustrated in FIG. 1, the print carriage 101 is constructed with two stalls 103*a* and 103*b* into which corresponding print cartridges (not shown in FIG. 1, but partially visible in FIGS. 2, 3 and 4, described below) are inserted. (Generally, the print carriage 101 can be constructed to accommodate any appropriate number of print cartridges). An ink reservoir is formed in each print cartridge. Each print cartridge also includes a printhead having a plurality of nozzles through which ink can be ejected. During printing, the print carriage 101 is moved laterally back and forth along the slider rod 102, and a print medium (such as paper, plastic transparency, white plastic with inkjet coating, or laminate) is advanced past the print carriage 101 (in particular, proximate to the printheads of the print cartridges in the space indicated generally by the bi-directional arrow 104) by a print drive mechanism to enable printing of a desired image or images on the print medium. The above-described structure and corresponding operation is conventional; the details of implementation of such structure and operation are well-known to those skilled in the art.

Figure 2:
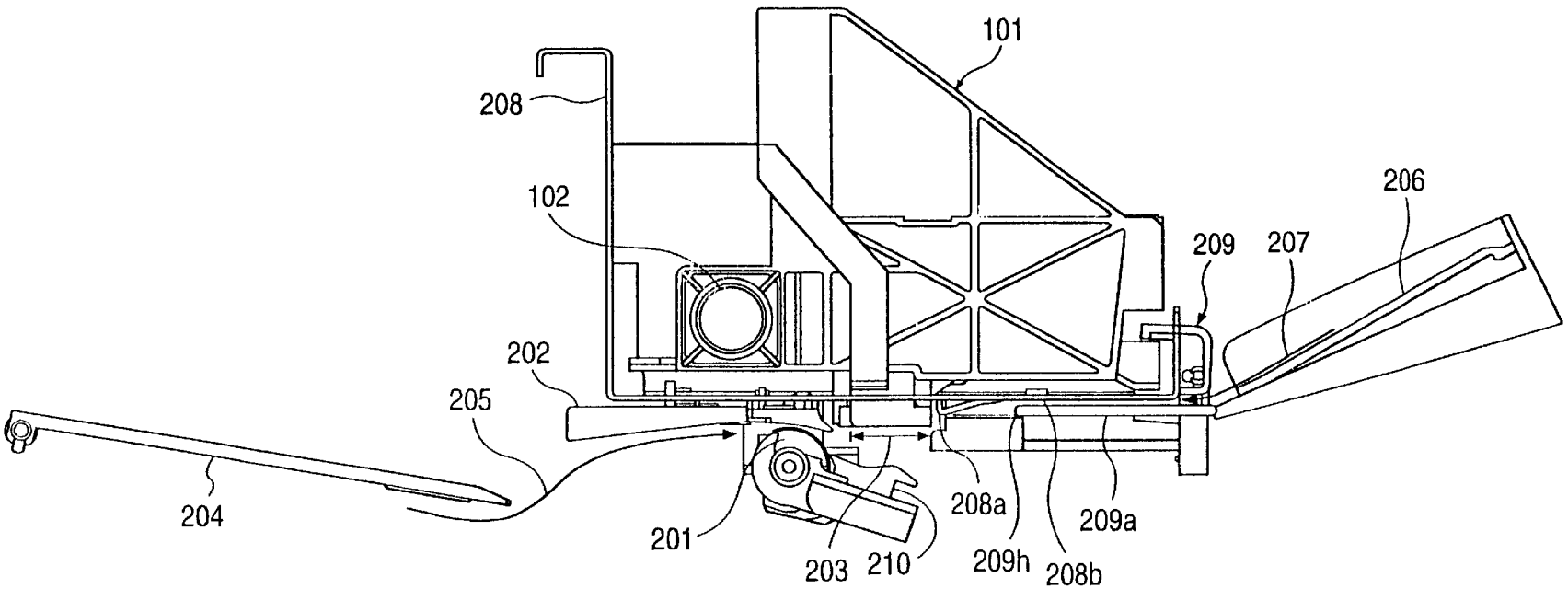
FIG. 2 is a cross-sectional view of the apparatus shown in FIG. 1, viewed in the direction of the section line A—A of FIG. 1, together with other printer apparatus not shown in FIG. 1, illustrating two modes of operation of the printer with which the apparatus is used.

FIG. 2 is a cross-sectional view of the apparatus shown in FIG. 1, viewed in the direction of the section line A—A of FIG. 1, together with other printer apparatus not shown in FIG. 1, illustrating two modes of operation of the printer with which the apparatus is used. In one mode of operation, a sheet (not shown) of a print medium is fed from a primary feed tray (which, typically, is a multi-sheet feed tray) to a print drive mechanism of the printer. (In the drawings, with the exception of a primary feed tray cover 204, for clarity, the primary feed tray and the structure for picking a sheet of a print medium from the tray and advancing the sheet to a drive roller 201 are not shown; the construction and operation of such structure is known to those skilled in the art.) Herein, "print drive mechanism" refers to the structure used to advance a print medium into a print zone during a printing operation to enable printing on the print medium to occur. In FIG. 2, the print drive mechanism includes the drive roller 201 and four pinch rollers (best shown in FIG. 1, and in FIGS. 3 and 4, described below); however, generally, any appropriate number of drive rollers and pinch rollers can be used. A print drive feed guide 202 helps to guide the sheet of the print medium to a nip region between the drive roller 201 and the pinch rollers. The "nip region" is a region of the print drive mechanism within which a normal force is applied to the print medium to ensure that sufficient friction exists between the print drive mechanism and the print medium to ensure that the print drive mechanism can advance the print medium in a controlled fashion. The drive roller 201 is rotated (clockwise, as shown in FIG. 2) to advance the sheet through the nip region and into a print zone (indicated by a bidirectional arrow 203), located underneath the printhead(s) of the print cartridge(s) (not shown in the drawings), within which printing on the sheet of the print medium occurs. For convenience, the above-described mode of operation is referred to hereinafter as the "standard" mode of operation and the path 205 that a sheet of a print medium follows from the primary feed tray to the drive roller 201 of the print drive mechanism is referred to hereinafter as the "standard feed path." Typically, the standard mode of operation encompasses automatic feeding of sheets of print media through the print zone 203 of the printer and/or feeding of sheets from a stack of multiple sheets of print media.

In another mode of operation of the printer, described in greater detail below, a sheet (not shown) of a print medium is fed from a secondary feed tray 206 to the print drive mechanism and advanced through the print zone 203. For convenience, this mode of operation is referred to hereinafter as the "secondary" mode of operation and the path 207 that the sheet follows from the secondary feed tray 206 to the drive roller 201 of the print drive mechanism is referred to hereinafter as the "secondary feed path." In the secondary mode of operation, often a single sheet of a print medium is positioned in the secondary feed tray 206 for feeding into the print drive mechanism, though, strictly speaking, this need not necessarily be the case. Additionally, in the secondary mode of operation, the sheet or sheets of a print medium are typically manually fed through the secondary feed path 207 to the print drive mechanism. Again, however, this need not necessarily be the case; in some embodiments of the invention, the printer can be constructed so that sheets are automatically picked from the secondary feed tray 206 and fed through the secondary feed path 207.

As can be appreciated from FIG. 2, the position of the secondary feed tray 206 relative to the drive roller 201 makes it preferable during the secondary mode of operation to feed sheets into the drive roller 201 in a direction opposite that in which sheets are fed during the standard mode of operation, i.e., the direction of motion along the secondary feed path 207 into the print drive mechanism is preferably opposite that of the direction of motion along the standard feed path 205 into the print drive mechanism. As can also be appreciated from FIG. 2, this necessitates that, in the secondary mode of operation, sheets be fed into the drive roller 201 after traversing the print zone 203. A permanent support cannot be provided for a sheet in the region of the print zone 203, since the upper portion of the print zone 203 must be open during printing to allow movement of the print carriage, and the lower portion of the print zone 203 must be open after printing to allow the sheet of the print medium to be released from the printer (as described further below). Because most print media are relatively flexible, this lack of support can be problematic, since, without support, the sheet may bend during feeding through the secondary feed path 207 such that the leading edge of the sheet does not properly enter the nip region between the drive roller 201 and pinch rollers. Further, the leading edge of the sheet is typically curved, warped and/or curled (viewed in the plane of the sheet in the direction of the feed path), i.e., has a "wavy" shape, thus exacerbating any difficulty in ensuring that the sheet is properly fed into the nip region.

As will be better appreciated from the description below, the invention can enable a sheet of a print medium to be fed along a secondary feed path in a manner that ensures accurate introduction of the sheet into the nip region of a print drive mechanism without addition of expensive, complex or bulky structure to the printer. In particular, the invention can enable this to be accomplished for a secondary feed path in which the sheet is fed into the print drive mechanism in a direction opposite that in which sheets of print media are fed using a standard feed path and/or for a secondary feed path in which the sheet must traverse a relatively lengthy unsupported area (e.g., a print zone of the printer) just prior to entering the nip region. Advantageously, the invention can accomplish the above-described feeding of a print medium along a secondary feed path without necessity to add a drive mechanism to the printer to facilitate such feeding.

In the apparatus illustrated in FIG. 2, in the secondary mode of operation, a sheet of a print medium is moved from the secondary feed tray 206 into a slot (the "secondary feed path slot") formed by a surface 208*b* of the chassis 208 and a planar portion 209*a* of a shim 209. As discussed in more detail below, a sensing system detects when a sheet of a print medium has been inserted into the secondary feed path slot; when such insertion has been detected, a printer control system (e.g., an electronic control system) begins rotating the drive roller 201. A bend 208*a* is formed in the chassis 208, so that, just after the sheet leaves the secondary feed path slot, the leading edge of the sheet is forced away from the surface 208*b* of the chassis 208 by the bend 208*a* in the chassis 208. The sheet traverses the print zone 203, the leading edge of the sheet eventually contacting a media guide 210 (which is part of a rotatable structure that enables the media guide 210 to be rotated into a desired position, as explained in more detail below) that guides the sheet into the nip region between the drive roller 201 and the pinch rollers. The drive roller 201 is rotated (in a direction opposite that in which the drive roller 201 is rotated to push a sheet of a print medium into the print zone 203 for printing, i.e., counterclockwise, as shown in FIG. 2) to pull the sheet through the nip region. The primary media tray is positioned so that the portion of the sheet first pulled through the nip region is supported by the primary feed tray cover 204. The sheet is not pulled completely through the nip region; the drive roller 201 stops rotating when the sheet has been pulled through the nip region to a printing position at which the sheet is positioned so that printing can begin. The drive roller 201 is then rotated in the opposite direction (i.e., clockwise, as shown in FIG. 2) to push the sheet back into the print zone 203 to enable printing to occur.

Figure 3:
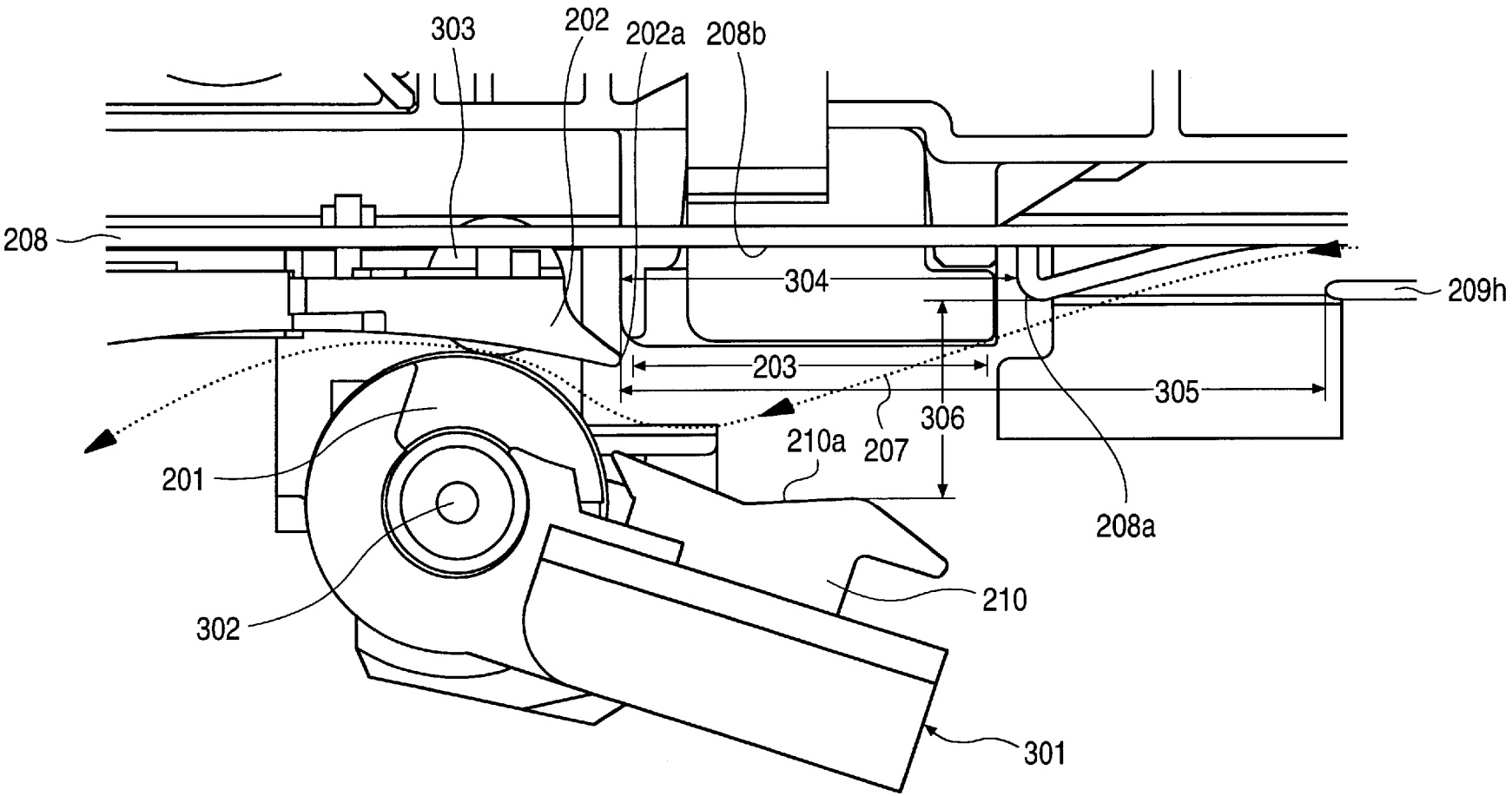
FIG. 3 is a detailed view of a portion of the cross-sectional view of FIG. 2, illustrating the operation of structure according to the invention during feeding of a sheet of a print medium into a print drive mechanism via a secondary feed path.

FIG. 3 is a detailed view of a portion of the cross-sectional view of FIG. 2, illustrating the operation of structure according to the invention during feeding of a sheet of a print medium into a print drive mechanism via a secondary feed path.

Figure 4:
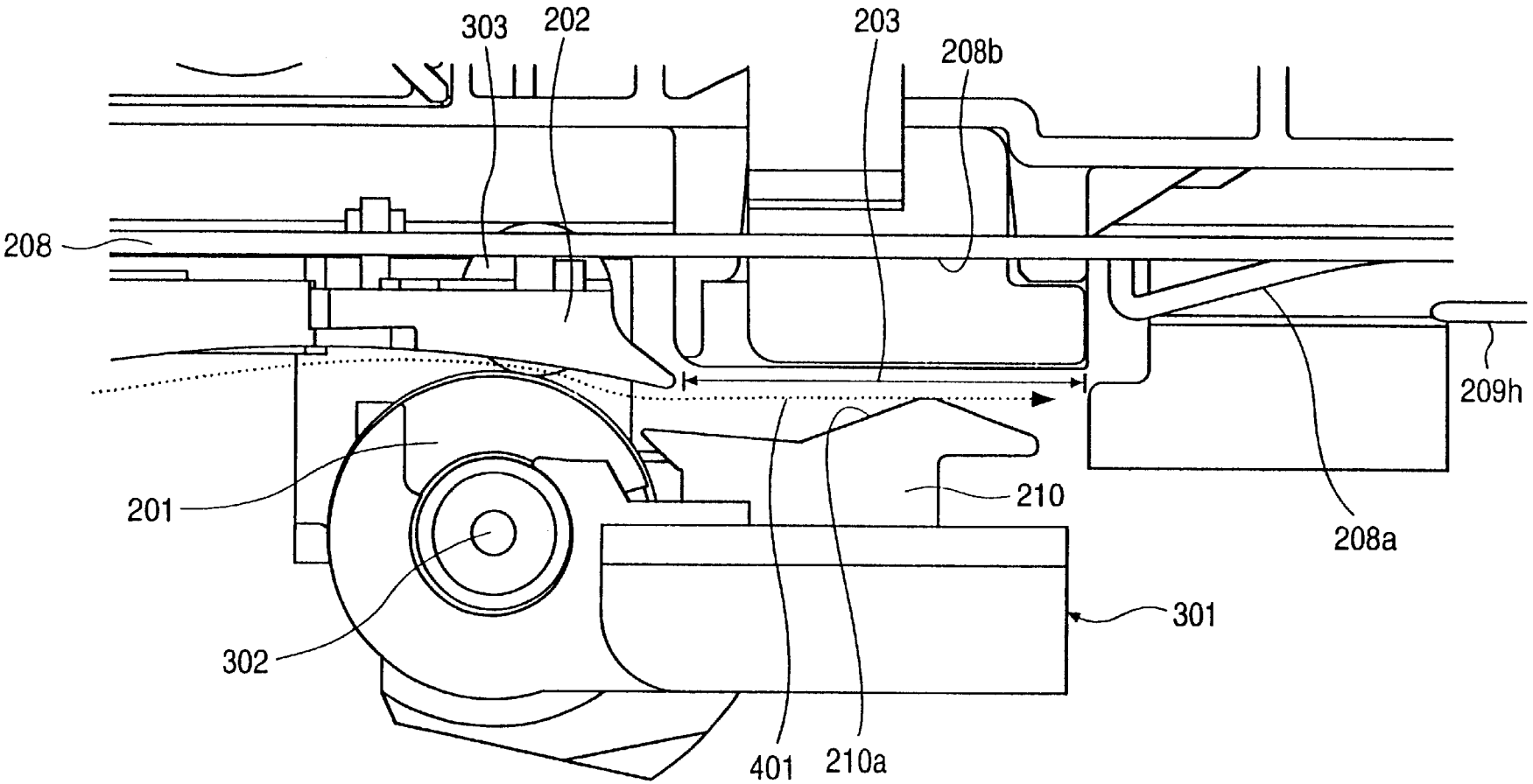
FIG. 4 is a detailed view of a portion of the cross-sectional view of FIG. 2, illustrating the operation of structure according to the invention during printing.

The media guide 210 is formed as part of a structure 301 that is mounted on a rotatable shaft 302. Generally, the media guide 210 can be formed on, or attached to, any suitable rotatable structure that enables the media guide 210 to be positioned in predetermined positions as described below. The construction and operation of a rotatable structure including the media guide 210 according to the embodiment of the invention illustrated in FIGS. 3 and 4 is described in detail in commonly owned, co-pending U.S. patent application Ser. No. 08/814,564 now U.S. Pat. No. 5,797,687, entitled "Paper Stacker Activation for Printer Input/Output", by David M. Petersen et al., filed on Mar. 11, 1997, the disclosure of which is incorporated by reference herein.

In the embodiment of a rotatable structure described in Petersen et al., the structure 301 and shaft 302 are constructed and mounted with respect to each other in a manner that enables the structure 301 to be engaged or disengaged from the shaft 302 to enable rotation and/or translation (along a translational axis parallel to the axis of rotation of the shaft 302) of the structure 301. The structure 301 is spring-loaded so that the structure 301 is biased along the translational axis toward a print position in which the structure 301 can be engaged by a stop (formed as part of, or fixedly attached to, the chassis 208) that holds the structure 301 in a predetermined rotational position for printing (see FIG. 4 below). The structure 301 and shaft 302 are constructed such that, in the print position, the structure 301 is disengaged from the shaft 302 so that the shaft 302 can be operated to rotate the drive roller 201 (to enable printing) without rotating the structure 301.

Movement of the print carriage 101 is used to effect translational movement of the structure 301. A print carriage contact mechanism is mounted on the shaft 302 such that rotation of the shaft 302 can position the print carriage contact mechanism so that the print carriage contact mechanism either contacts or does not contact the print carriage 101 as the print carriage 101 moves. The print carriage contact mechanism is further positioned with respect to the structure 301 such that translational movement of the print carriage contact mechanism (in response to movement of the print carriage 101) results in contact with the structure 301 that moves the structure 301 in a direction opposite the spring bias force. This movement releases the structure 301 from the stop and engages the structure 301 with the shaft 302, so that the shaft 302 can be rotated to change the rotational position of the structure 301. As described in more detail below, in general, the shaft 302 can be rotated to position the structure 301 in any desired rotational position. Once the structure 301 has been rotated to a now rotational position, the print carriage 101 can be moved so that the print carriage contact mechanism (which is biased by a spring in the same direction as the structure 301) and the structure 301 are forced back to a translational position at which the structure 301 is no longer engaged with the shaft 302. Further, at such translational position, for any particular rotational position the structure 301 can be held in place rotationally by a stop (formed as part of, or fixedly attached to, the chassis 208), similar to the stop described above for holding the structure 301 in the print position. (Such a stop may not be used when the structure 301 is positioned in a media release position, described below.)

In general, the rotatable structure can be constructed and/or operated so that the shaft 302 can be rotated to an appropriate angular position to enable the media guide 210 to be positioned at any desired position. Typically, the positions of the media guide 210 are confined to a range of positions, the limits of which are imposed by the presence of other structure of the printer. For example, in one embodiment of the invention, the rotatable structure including the media guide 210 can be rotated between a position (a "print position," shown in FIG. 4, discussed below) in which a portion of a media contact surface 210*a* of the media guide 210 that is closest to the printhead(s) of the print cartridge(s) supports a print medium so as to maintain a desired spacing within the print zone 203 between the print medium and the printhead(s) (hereinafter defined as a position in which the rotatable structure has an angular orientation of 0°) and a position (a "media release position") in which the rotatable structure has been rotated about 90°–95° clockwise (as viewed in FIGS. 3 and 4) from the print position (hereinafter defined as a position in which the rotatable structure has an angular orientation of about 90°–95°).

In particular, the rotatable structure can be rotated to position the media guide 210 into a position (a "sheet feed position") that ensures that a sheet being fed through the secondary feed path 207 will be properly guided into the nip region between the drive roller 201 and the pinch rollers (one of the pinch rollers, designated by the numeral 303, is visible in FIG. 3, as well as FIG. 4, described below). Generally, as illustrated in FIG. 3, this can be accomplished by positioning the rotatable structure at an angular orientation such that the media contact surface 210*a* of the media guide 210 is lower, relative to the secondary feed path 207, than at the print position (though the media guide 210 can also be positioned in the print position during feeding of a sheet of a print medium). Preferably, in the sheet feed position, the rotatable structure has an angular orientation of greaser than about 0° measured in the clockwise direction in FIGS. 3 and 4), more preferably greater than about 5° and most preferably greater than about 10°. The magnitude of the angular orientation of the rotatable structure should not be so great that, if the leading edge of the sheet contacts the media guide 210, the sheet binds up or is misdirected away from the nip region. Preferably, in the sheet feed position, the rotatable structure has an angular orientation of less than about 90°, more preferably less than about 45° and most preferably less than about 30°. In one particular embodiment of the invention, the rotatable structure has an angular orientation of about 18° (shown in FIG. 3) in the sheet feed position.

As indicated above, the bend 208*a* in the chassis 208 forces the leading edge of a sheet being fed through the secondary feed path 207 away from the surface 208*b* of the chassis 208. The presence of the bend 208*a* to guide the sheet produces several advantageous effects.

First, since, absent the bend 208*a*, the sheet would tend to continue moving along the plane defined by the secondary feed path slot between the surface 208*b* of the chassis 208 and the planar portion 209*a* of the shim 209, the bend 208*a* applies a force to the sheet (deflecting the sheet) that is resisted by the sheet, thereby causing the sheet to stiffen locally near the end of the bend 208*a*. In particular, this stiffening helps control the position of the leading edge of the sheet as the leading edge of the sheet traverses the print zone 203 so that proper entrance of the sheet into the nip region can be better ensured.

Second, the bend 208*a* is formed so that the sheet is deflected to direct the sheet to a position between the print drive feed guide 202 and the media guide 210. The particular geometry of the bend 208*a* (e.g., in a structure as illustrated in FIG. 3, the angle between the substantially planar section of the bend 208*a* and the surface 208*b* of the chassis 208) can be established to accomplish this function, as can be appreciated by those skilled in the art, in view of other aspects of the construction and operation of the printer structure, such as, for example, the geometry and locations of the print drive feed guide 202 and the media guide 210 (e.g., the sheet feed position of the media guide 210) and a nominal specification of a location at which the leading edge of the sheet is to contact structure after traversing the print zone 203. For example, in the structure shown in FIG. 3, the angle between the substantially planar section of the bend 208*a* and the surface 208*b* of the chassis 208 is about 15°.

FIG. 4 is a detailed view of a portion of the cross-sectional view of FIG. 2, illustrating the operation of structure according to the invention during printing. As indicated above, after the drive roller 201 has pulled a sheet through the nip region to a printing position at which the sheet is positioned so that printing can begin, the drive roller 201 stops rotating. The printer control system rotates the rotatable structure so that the media guide 210 is positioned in the print position (described in more detail above). The printer control system then begins rotating the drive roller 201 in the opposite direction to push the sheet back into the print zone 203 through a printing path 401 to enable printing to occur. After passing through the print zone 203, the sheet moves into an output tray (not shown) positioned underneath the planar portion 209*a* of the shim 209. Once printing has been completed (determined in any suitable manner, as known to those skilled in the art, such as by using, for example, a paper edge detector sensor positioned, for example, proximate to the printing path 401 on a side of the drive roller 201 opposite the print zone 203) and the sheet has been ejected from the nip region, the printer control system rotates the media guide 210 to the media release position, allowing the remainder of the sheet to fall into the output tray.

As discussed in more detail in the above-referenced U.S. patent application Ser. No. 08/814,564 U.S. Pat. No. 5,797, 687 and indicated above, the rotatable structure of the embodiment of the invention shown in FIGS. 3 and 4 is a spring-loaded structure that can be locked into each of the print position, the sheet feed position and the media release position. Thus, in general, to place the media guide 210 in the sheet feed position from another position, the rotatable structure must be moved against the spring force to unlock the rotatable structure, then rotated into the sheet feed position. Thus, preferably, when the printer is not in use, the rotatable structure is rotated so that the "default" position of the media guide 210 is the sheet feed position, thus enabling the printer, when not in operation, to always be ready for use in the secondary mode of operation. However, other default positions of the media guide 210 can be used, particularly in embodiments of the invention in which a rotatable structure having another construction is used.

The media contact surface 210*a* of the media guide 210 can also be shaped in a particular manner to achieve particular functionality. For example, as discussed above, the media contact surface 210*a* should be shaped so that, when the media guide 210 is placed in the print position, the media contact surface 210*a* supports the print medium at a desired spacing from the printhead(s) of the print cartridge(s). The media contact surface 210*a* can also be shaped so that the media contact surface 210*a* slopes downward, relative to the secondary feed path 207, from a first location to a second location that is nearer the secondary feed path slot than the first location, thus aiding in guiding a sheet of a print medium toward the print drive mechanism. It may also be desirable to shape the media contact surface 210*a* by providing a downward slope, relative to the secondary feed path 207, from the location at which the print medium contacts the media contact surface 210*a* during printing to a location that is nearer the print drive mechanism than that contact location, such shaping causing the print medium to bend and locally stiffen just prior to entering the print drive mechanism, thereby enhancing the control of the leading edge of the print medium so that the likelihood of proper entry of the print medium to the nip region of the print drive mechanism is increased. In the embodiment of the invention shown in FIGS. 3 and 4, the media contact surface 210*a* of the media guide 210 has been shaped so as to accomplish these purposes.

Figure 5:
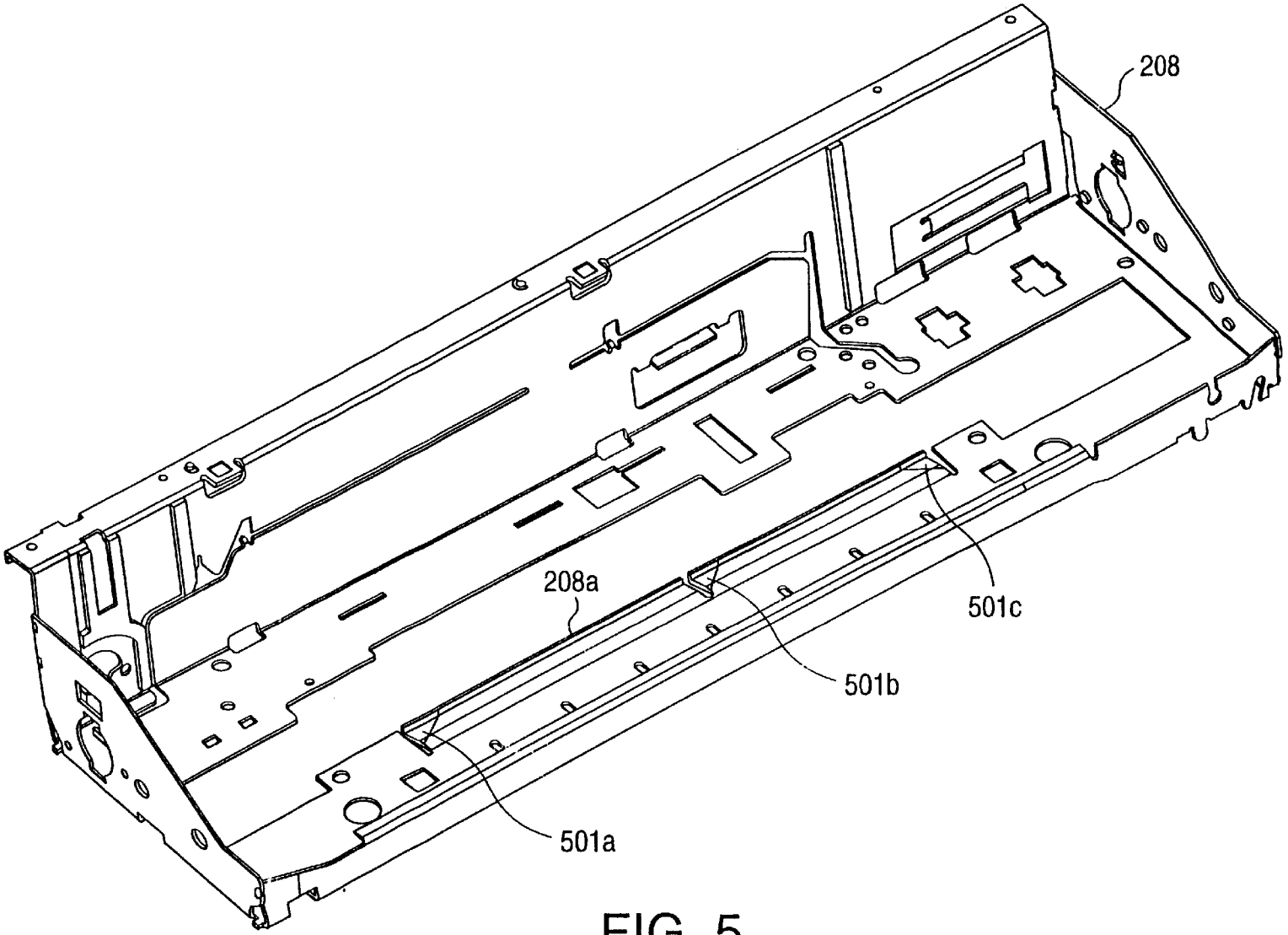
FIG. 5 is a perspective view of the apparatus shown in FIG. 1, viewed in the same direction as in FIG. 1, without some of the structure shown in FIG. 1, illustrating the presence of "frown" features according to the invention.

FIG. 5 is a perspective view of the apparatus shown in FIG. 1, viewed from the same direction as in FIG. 1, without some of the structure shown in FIG. 1. FIG. 5 illustrates the presence of "frown" features 501*a*, 501*b* and 501*c* in structure according to the invention. (The frown features 501*a*, 501*b* and 501*c* need not necessarily be present in a structure according to the invention.) Each of the frown features 501*a*, 501*b* and 501*c* is a bend of a corner of the bend 208*a* of the chassis 208, the bend being toward the secondary feed path (i.e., into the plane of FIG. 5, or downward). The downward bend of the frown features 501*a*, 501*b* and 501*c* locally deforms the print medium along the longitudinal edges of the print medium, helping to eliminate some of the "waviness" (as viewed in the plane of the print medium in the direction of the feed path) that is typically present in a print medium that may otherwise create a problem in accurately feeding the print medium along the secondary feed path 207 into the print drive mechanism. The frown features 501*a* and 501*c* can be used to provide such deformation in print media having a first particular width (e.g., letter size paper), while the frown features 501*b* and 501*c* can be used to provide such deformation in print media having a second particular width that is smaller than the first width.

Figure 6A:
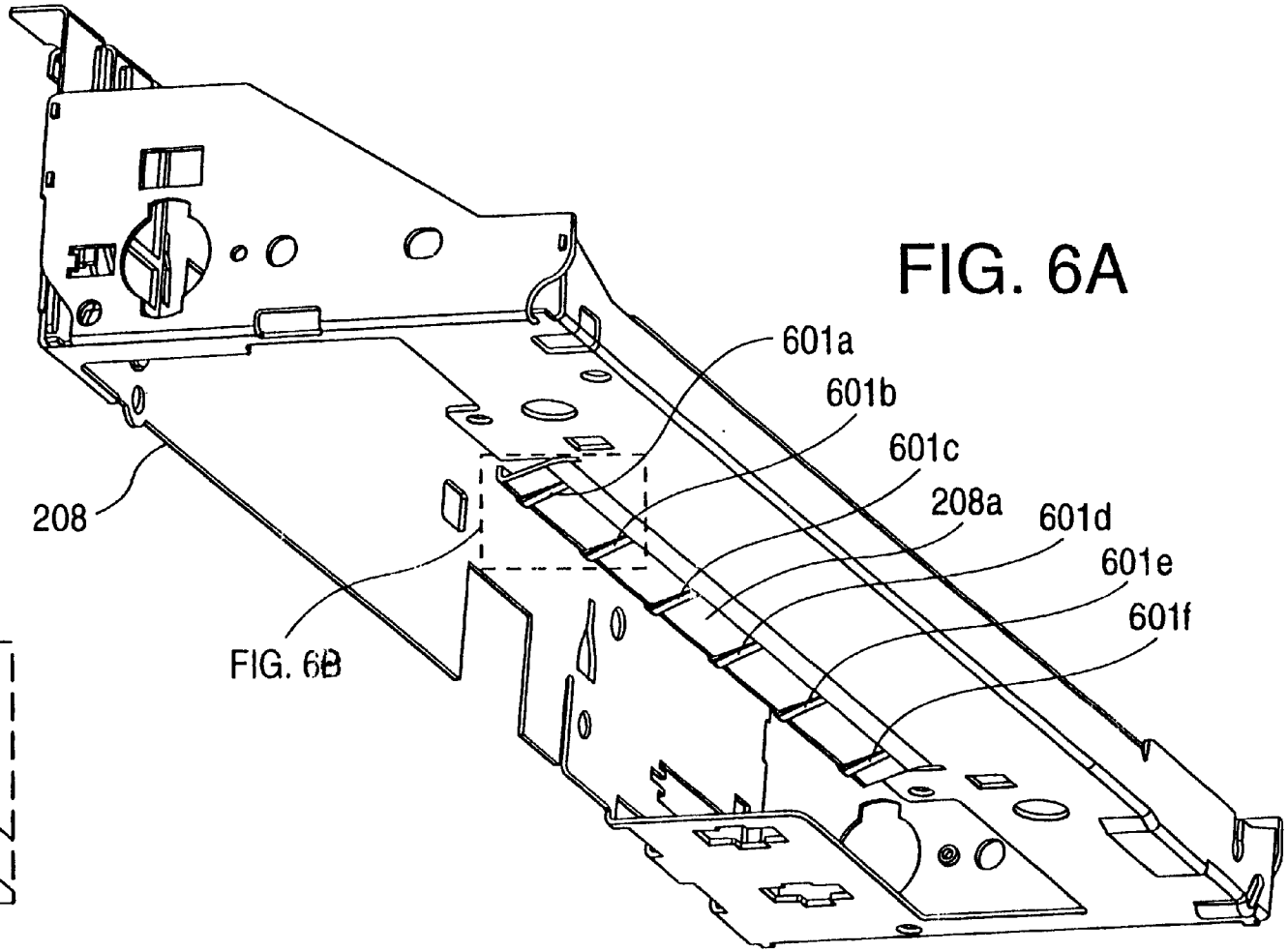
FIG. 6A is a perspective view of the apparatus shown in FIG. 5, viewed from underneath the apparatus, illustrating ribs formed on the chassis that reduce friction between the chassis and a sheet of a print medium passing through a secondary feed path.
Figure 6B:
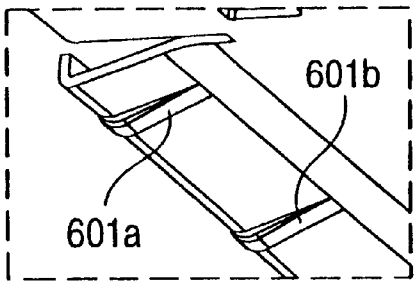
FIG. 6B is a detailed view of a portion of the perspective view of FIG. 6A, better illustrating the ribs formed on the chassis.

FIG. 6A is a perspective view of the apparatus shown in FIG. 5, viewed from underneath the apparatus. As described above, the bend 208*a* (FIGS. 2, 3 and 4) of the chassis 208 imparts a force to the sheet as the sheet is fed through the secondary feed path 207. In particular, this force generally produces an increase in the functional force resisting motion of the sheet through the secondary feed path 207. Thus, ribs 601*a* through 601*f* can be formed on the bend 208*a* to reduce the area of contact between the chassis 208 and the sheet, thereby reducing the frictional force opposing motion of the sheet. More generally, the invention contemplates the formation of any other appropriate structure as part of, or attached to, the bend 208*a* that reduces the contact area between the chassis 208 and the sheet. FIG. 6B is a detailed view of a portion of the perspective view of FIG. 6A, better illustrating the ribs 601*a* and 601*b* formed on the bend 208*a*.

The above-described structure according to the invention can enable a sheet of a print medium to traverse the relatively lengthy unsupported area of the print zone 203. Returning to FIG. 3, the horizontal (i.e., parallel to the surface 208*b* of the chassis) distance 304 from the edge 202*a* of the print drive feed guide 202 nearest the print zone 203 to the end of the bend 208*a* adjacent the print zone 203 is about 0.9 inches. The horizontal distance 305 from the edge 202*a* of the print drive feed guide 202 to the end 209*h* of the planar portion 209*a* of the shim 209 nearest the bend 208*a* is about 1.5 inches. In the position shown in FIG. 3, the vertical (i.e., perpendicular to the surface 208*b* of the chassis) distance 306 from the end of the bend 208*a* adjacent the print zone 203 to the nearest part of the media contact surface 210*a* of the media guide 210 is about 0.5 inches. In general, similar structure according to the invention can be used to enable a print medium to traverse a gap in any path in a printer through which the print medium travels. The magnitude of such gaps can be, for example, greater than about 0.25 inches. With appropriate implementation of the principles of the invention, gaps greater than about 0.5 inches or greater than about 1.0 inches can be traversed. In particular implementations of the invention, the gaps that can be traversed can be up to, for example, about 1.5 inches or about 2.0 inches.

Figure 7A:
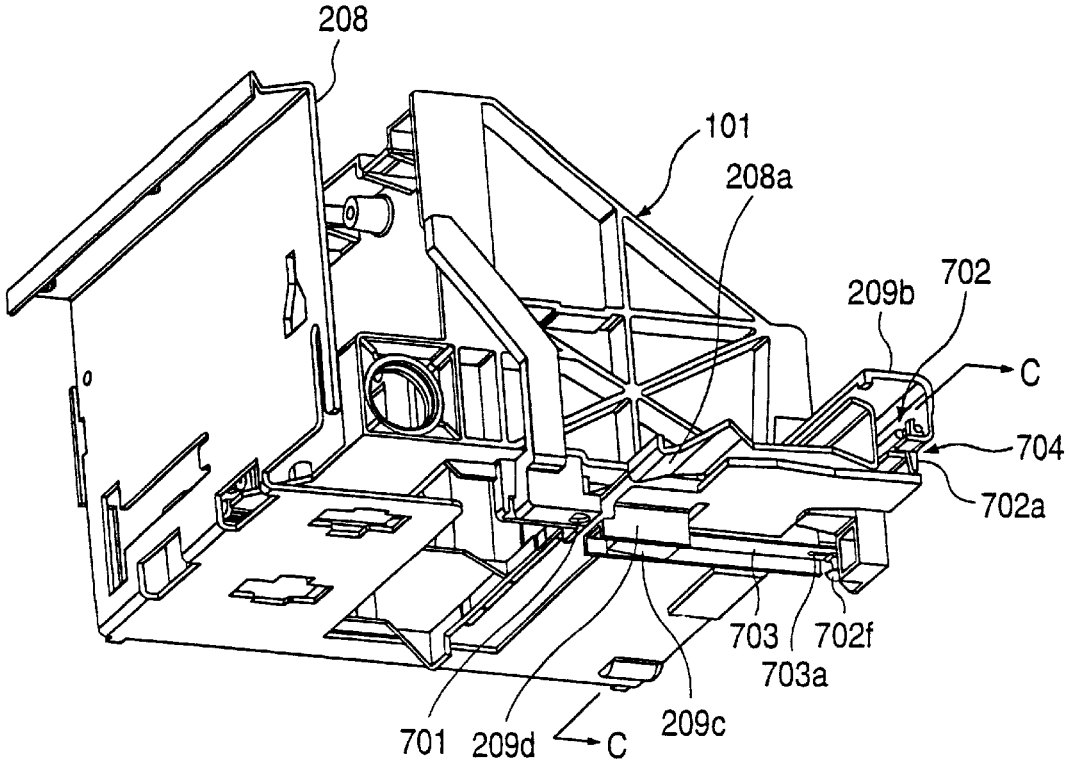
FIGS. 7A and 7B are each perspective views of a portion of the apparatus shown in FIG. 1, viewed from underneath the apparatus and in the direction of the section line B—B of FIG. 1, illustrating a print medium insertion sensing system according to the invention.
Figure 7B:
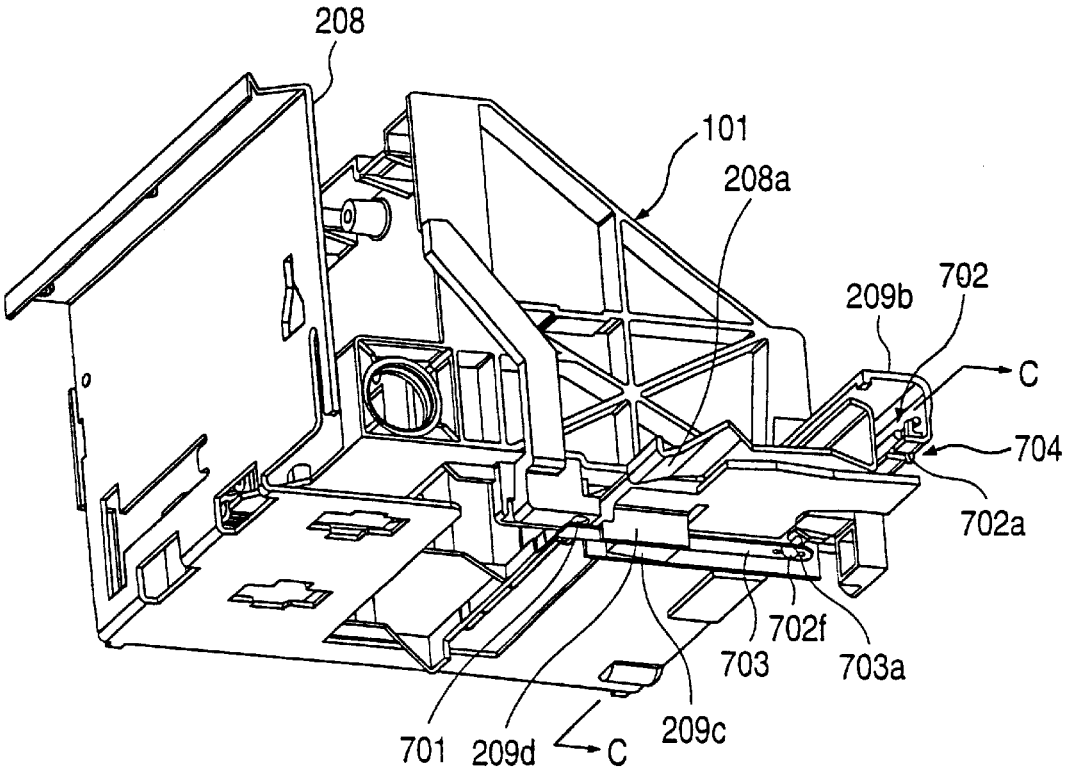
Figure 8A:
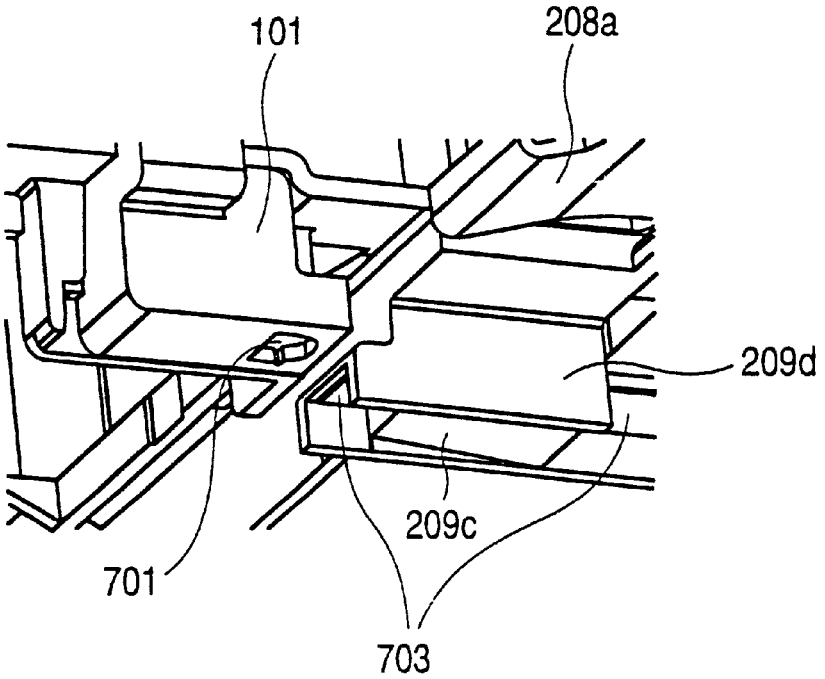
FIGS. 8A and 8B are detailed views of a portion of the perspective views of FIGS. 7A and 7B, respectively, illustrating the trigger flag of the print medium insertion sensing system in more detail.
Figure 8B:
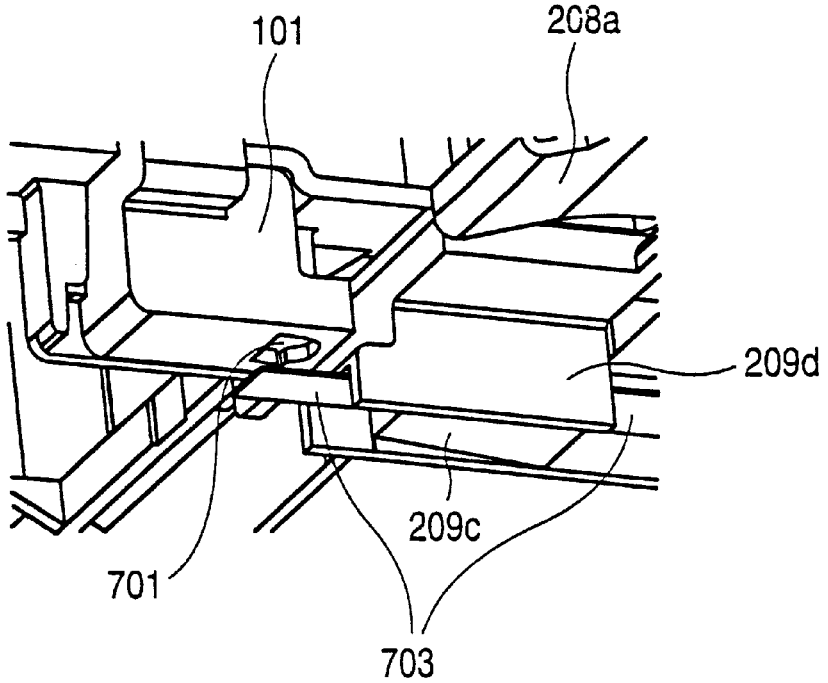
Figure 9B:
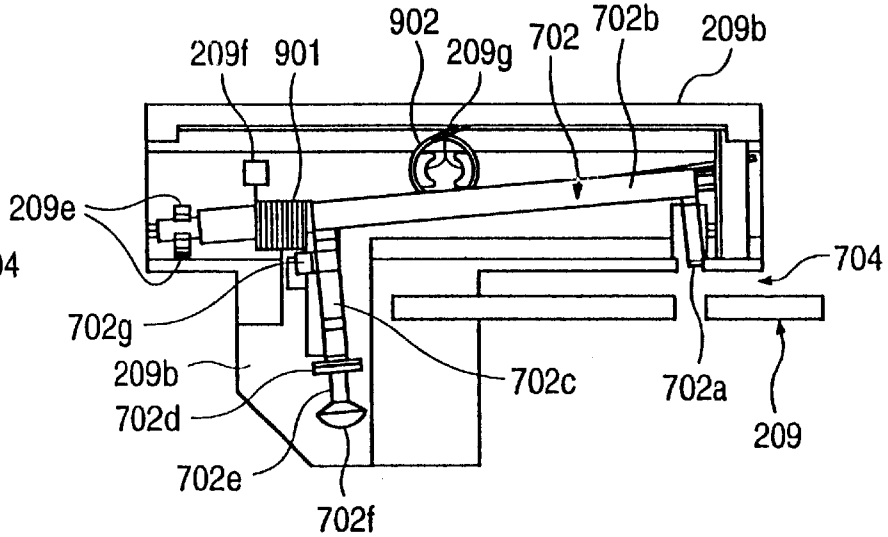
FIGS. 9A and 9B are cross-sectional views, viewed in the direction of the section line C—C of FIGS. 7A and 7B, of a trigger structure of a print medium insertion sensing system according to the invention.
Figure 9A:
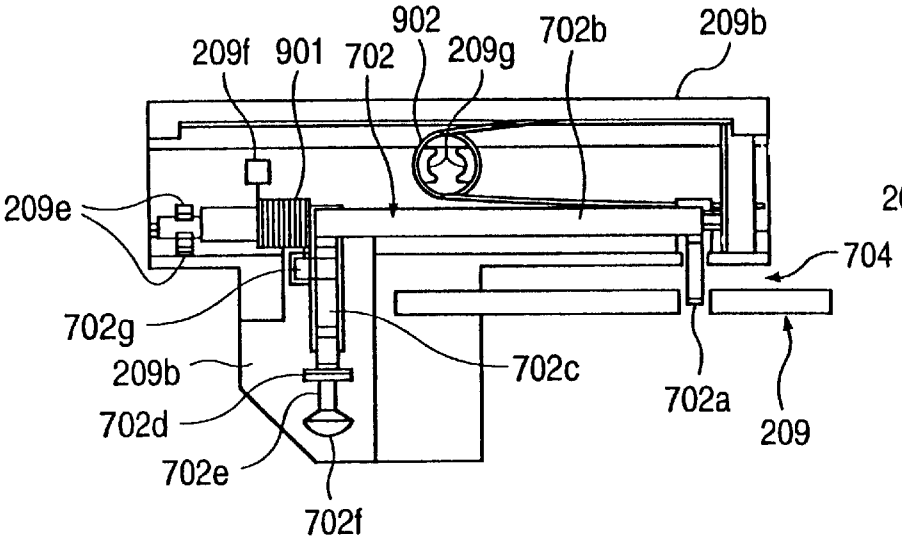

FIGS. 7A and 7B are each perspective views of a portion of the apparatus shown in FIG. 1, viewed from underneath the apparatus and in the direction of the section line B—B of FIG. 1, illustrating a print medium insertion sensing system according to the invention. FIG. 7A illustrates the sensing system when insertion of a sheet of a print medium has not been sensed, while FIG. 7B illustrates the sensing system when insertion of a sheet of a print medium has been sensed. FIGS. 8A and 8B are detailed views of a portion of the perspective views of FIGS. 7A and 7B, respectively, illustrating a trigger flag 703 of the print medium insertion sensing system in more detail. FIGS. 9A and 9B are cross-sectional views, viewed in the direction of the section line C—C of FIGS. 7A and 7B, of a trigger structure 702 of a print medium insertion sensing system according to the invention. FIG. 9A illustrates the trigger structure 702 when insertion of a sheet of a print medium has not been sensed. FIG. 9B illustrates the operation of a mechanism for avoiding self-locking of the trigger structure 702 when a sheet of a print medium is removed from the secondary feed path.

A print media edge detection sensor 701 (best shown in FIGS. 8A and 8B) is positioned on the print carriage 101. The sensor 701 can be embodied by any appropriate sensing device, such as, for example, a reflective-type sensor that emits a beam and measures the intensity of any reflected beam. At the beginning of a printing operation (during either the standard or secondary mode of operation of the printer), the sensor 701 senses when the leading edge of a print medium passes underneath the sensor 701. As is understood by those skilled in the art, this information is used to control movement of the print carriage 101 and advancement of the print medium so that printing is begun on the print medium at an appropriate location. As will be better appreciated from the further description below, the print medium insertion sensing system according to the invention makes use of the print media edge detection sensor 701, which is already provided in the printer to enable printing operations, to enable sensing of insertion of a print medium into the secondary feed path 207 (FIG. 2) during the secondary mode of operation of the printer.

The trigger structure 702 (indicated generally in FIGS. 7A and 7B, and shown more completely in FIGS. 9A and 9B, described below) is rotatably supported in a trigger housing 209b that is formed as part of the shim 209, as described in more detail below with respect to FIG. 9A. The trigger structure 702 includes a print media contact portion 702*a* that is moved in response to insertion of a sheet of a print medium into the secondary feed path slot (designated by the numeral 704 in FIGS. 7A, 7B, 9A and 9B, and described above with respect to FIG. 2,), as described further below.

The trigger structure 702 is, in turn, rotated as a result of movement of the print media contact portion 702*a* (as described further below with respect to FIG. 9A). A trigger flag 703 is attached to the trigger structure 702 (as described in more detail below with respect to FIG. 9A) and supported by a trigger flag support portion 209*c* of a trigger flag housing 209*d* that is formed as part of the shim 209. The trigger flag 703 moves over the trigger flag support portion 209*c* of the trigger flag housing 209*d* in response to rotation of the trigger structure 702. The trigger flag 703 and the trigger structure 702 must have a mass low enough (in combination with the distribution of the mass about the axis of rotation of the trigger structure 702) to enable insertion of a sheet of a print medium into the secondary feed path slot 704 to move the trigger flag 703 and trigger structure 702. Illustratively, the combined mass of the trigger flag 703 and the print media contact portion 702*a* can be between about 0.1 grams and 0.25 grams.

If a sheet of a print medium has not been inserted into the secondary feed path slot 704, the print media contact portion 702*a* of the trigger structure 702 is positioned as shown in FIG. 7A. This position of the print media contact portion 702*a* of the trigger structure 702 results in a position of the trigger flag 703 in which the trigger flag 703 is withdrawn into the trigger flag housing 209*d*, as shown in FIG. 7A. This position is shown in more detail in FIG. 8A. The trigger flag housing 209*d* helps to prevent contaminants (in particular, aerosol from the print cartridges) from collecting on the trigger flag 703. This is particularly advantageous when the sensor 701 is a reflective-type sensor, since the collection of contaminants on the trigger flag 703 may eventually degrade the reflectivity of the trigger flag 703 so that the trigger flag 703 does not produce a reflection that is strong enough to be detected by the sensor 701.

When a sheet of a print medium is inserted into the secondary feed path slot 704, the sheet contacts the print media contact portion 702*a* of the trigger structure 702. As the sheet moves further into the secondary feed path slot 704, the sheet pushes the print media contact portion 702*a*, causing the trigger structure 702 to rotate, which, in turn, moves the trigger flag 703 so that the trigger flag 703 extends outside of the trigger flag housing 209*d*, as shown in FIG. 7B. This position is shown in more detail in FIG. 8B. At a time when a sheet of a print medium is inserted into the secondary feed path 207 (in accordance with correct operation of the printer), the print carriage 101 is positioned in a "park" position (i.e., a predetermined position of the print carriage when the print cartridges are not printing and are not being serviced) as shown in FIGS. 7A and 7B. The trigger structure 702, trigger flag housing 209*d* and trigger flag 703 are positioned so that, when the trigger flag 703 extends out of the trigger flag housing 209*d*, the trigger flag 703 passes underneath the sensor 701. The sensor 701 is operated so that the sensor 701 is active (i.e., capable of sensing an object of the type that the sensor 701 is adapted to sense when such object is within the field of detection of the sensor 701) at times when a sheet of print medium can be (properly) inserted into the secondary feed path 207. (This can be accomplished, for example, by making the sensor 701 always active, which is desirable, too, in view of the fact that the sensor 701 is also used to sense the leading edge of a print medium at the beginning of a printing operation). Thus, when the trigger flag 703 extends outside of the trigger housing 209*b*, the sensor 701 senses this event, and transmits a signal to the printer control system indicating that a sheet of a print medium has been inserted into the secondary feed path 207. It is important to note that this sensing signal from the sensor 701 indicating the presence of a sheet of a print medium in the secondary feed path 207 can be distinguished from a sensing signal produced by the detection of a sheet of a print medium during a printing operation because those two events occur (during proper operation of the printer) during distinct and non-overlapping periods of operation of the printer, e.g., a sheet of a print medium cannot permissibly be fed into the secondary feed path 207 during a printing operation (though such could, of course, occur if the printer is being used improperly).

FIG. 9A is a cross-sectional view, viewed in the direction of the section line C—C of FIGS. 7A and 7B, of the trigger structure 702, illustrating the operation and construction of the trigger structure 702 in more detail. The trigger structure 702 includes a shaft portion 702*b* having multiple sections of different diameters, the aforementioned print media contact portion 702*a*, and a trigger flag retention port on 702*c*.

One end of the shaft portion 702*b* is rotatably held in place by opposed retention arms 209*e* formed on the trigger housing 209*b*. The retention arms 209*e* are shaped and sized, and the diameter of the corresponding section of the shaft portion 702*b* is sized, so that the shaft portion 702*b* can be snapped into place by pushing the shaft portion 702*b* between the retention arms 209*e*. The opposite end of the shaft portion 702*b* is fitted into a slot (not visible in FIG. 9A) formed in the trigger housing 209*b*, the width of the slot and the diameter of the corresponding section of the shaft portion 702*b* being established so that the section of the shaft portion 702*b* is held in place along an axis perpendicular to the plane of FIG. 9A while allowing rotation of the shaft portion 702*b* within the slot. Normally, as explained further below, the end of the shaft portion 702*b* fits against one end of the slot so that the trigger structure 702 is positioned as shown in FIG. 9A.

An opening is formed in the trigger housing 209*b* to allow the print media contact portion 702*a* to extend into the secondary feed path slot 704.

A knob 702*f* is formed at the free end of the trigger flag retention portion 702*c*. A flange 702*d* is formed on the trigger flag retention portion 702*c* a short distance from the knob 702*f*. A hole (not readily visible in the drawings) is formed in the trigger flag 703, the hole being made sufficiently large to enable the section 702*e* of the trigger flag retention portion 702*c* between the flange 702*d* and knob 702*f* to fit through the hole, but sufficiently small so that neither the flange 702*d* nor the knob 702*f* can fit through the hole. The flange 702*d* and knob 702*f* thus hold the trigger flag 703 in place on the trigger structure 702.

A slit 703*a* is formed in the trigger flag 703 adjacent to the hole to enable an opening to be formed in the trigger flag 703 that allows the trigger flag 703 to be fitted over the knob 702*f* so that the trigger flag 703 can be attached to the trigger structure 702.

The trigger flag retention portion 702*c* is formed with a bend that enables the trigger flag retention portion 702*c* to fit around an edge of the chassis 208 when insertion of a sheet of a print medium into the secondary feed path slot 704 causes the trigger structure 702 to rotate such that the trigger flag retention portion 702*c* moves in a direction out of the plane of FIG. 9A.

A spring retention block 702*g* having a small hole formed therethrough is formed as part of the trigger flag retention portion 702*c* near the shaft portion 702*b* of the trigger structure 702. A similar spring retention block 209*f* having a small hole formed therethrough is formed as part of the trigger housing 209*b*. A spring 901 is fitted over the shaft portion 702*b* of the trigger structure 702, the spring 901 having extending portions at either end that fit through the holes in the spring retention blocks 702*g* and 209*f* of the trigger flag retention portion 702*c* and the trigger housing 209*b*, respectively. The extending portions of the spring 901 are formed so that, when the trigger structure 702 is positioned as shown in FIG. 9A, the spring 901 is slightly deformed, thereby providing a force that tends to hold the trigger structure 702 in that position (contact between the trigger flag 703 and the trigger housing 209*b* prevents the trigger structure 702 from rotating further). This spring force increases as the trigger structure 702 is rotated-when a sheet of a print medium is inserted in the secondary feed path 207 (as shown in FIG. 7B), so that, after the sheet has passed entirely beyond the print media contact portion 702*a*, the trigger structure 702 rotates back to the position shown in FIG. 9A (and FIG. 7B). The spring constant of the spring 901 and the geometry of the relevant parts of the structure that determine the amount of displacement of the spring 901 are established so that the spring 901 produces a nominal range of spring forces between about 0.25 grams force and about 0.5 grams force.

FIG. 9B is a cross-sectional view, viewed in the same direction as FIG. 9A, of the trigger structure 702, illustrating the operation of a mechanism for avoiding self-locking of the trigger structure 702 when a sheet of a print medium is removed from the secondary feed path 207 (FIG. 2). A V-shaped spring 902 ("anti-lock spring") is fitted around a spring retention feature 209*g* formed on a wall of the trigger housing 209*b*. (The anti-lock spring 902 is not shown in FIGS. 7A and 7B.) One end of the anti-lock spring 902 is positioned within a recess formed by a lip that is part of the trigger housing 209*b*, and is held in place by the lip. The other end of the anti-lock spring 902 is positioned against the shaft portion 702*b* of the trigger structure 702 and within the slot formed in the trigger housing 209*b*. As will be more readily apparent from the description below, the anti-lock spring 902 provides a compliant support for the trigger structure 702 that allows the trigger structure 702 to move when a print medium is withdrawn from the secondary feed path 207 so that the print media contact portion 702*a* of the trigger structure 702 does not mark the print medium as the print medium is withdrawn.

When a sheet of a print medium is removed from the secondary feed path slot 704 after having been inserted in the slot 704, contact between the sheet and the print media contact portion 702*a* can cause the trigger structure 702 to be rotated in a direction opposite that in which the trigger structure 702 is rotated when the sheet is inserted into the slot 704. As the trigger structure 702 rotates in this direction, the print media contact portion 702*a* begins to dig into the sheet. The rotation is stopped by contact between the trigger flag 703 and the trigger housing 209*b* at a position at which there is a strong likelihood, absent the anti-locking mechanism according to the invention, of marking of the sheet as the sheet continues to be removed from the slot 704.

In particular, the above-described rotation of the trigger structure 702 can occur when the print media contact portion 702*a* makes a relatively large angle (e.g., greater than about 35°) with the plane of a sheet of a print medium (0° being defined to be the position of the trigger structure 702 at which the print media contact portion 702*a*is parallel to the plane of the sheet) when the trigger structure 702 has been rotated as a result of insertion of the sheet into the secondary feed path 207. The magnitude of this angle is a function of the length of the print media contact portion 702*a*: the shorter the length of the print media contact portion 702*a*, the greater the magnitude of the angle. Thus, when the print media contact portion 702*a* must be made relatively short (perhaps because the print media contact portion 702*a* must fit within a small space, as is the case in the structure shown in FIGS. 7A and 7B, in which the print media contact portion 702*a* cannot extend beyond the shim 209), a sheet of a print medium is particularly susceptible to being marked by the print media contact portion 702*a* when being removed from the secondary feed path 207 after having been inserted. (In the structure shown in FIGS. 7A and 7B, the magnitude of the angle between the print media contact portion 702*a* and the plane of an inserted sheet is about 55°.) However, in accordance with this aspect of the invention, since the end of the trigger structure 702 near the print media contact portion 702*a* is free to move within the slot formed in the trigger housing 209*b*, the trigger structure 702 can rotate, as shown in FIG. 9B, about an axis perpendicular to the plane of FIG. 9B, so that the print media contact portion 702*a* can move away from the sheet of the print medium as force begins to build up between the two, thus avoiding marking of the sheet.

The anti-lock spring 902 has an unstressed shape such that when the trigger structure 702 is positioned as shown in FIG. 9A, the anti-lock spring 902 is slightly deformed, thereby providing a force that tends to hold the trigger structure 702 in that position (contact between the ends of the shaft portion 702*b* of the trigger structure 702 and the retention arms 209*e* and slot wall, respectively, prevents the trigger structure 702 from rotating further). This spring force increases as the trigger structure 702 is rotated when a sheet of a print medium is withdrawn from the secondary feed path 207 and causes the trigger structure 702 to rotate as shown in FIG. 9B, so that, after the sheet has been entirely withdrawn from the secondary feed path 207, the trigger structure 702 rotates back to the position shown in FIG. 9A. The spring constant of the anti-lock spring 902 and the geometry of the relevant parts of the structure that determine the amount of displacement of the spring are established so that the anti-lock spring 902 produces a nominal range of spring forces between about 10 grams force and about 20 grams force.

The retention arms 209*e* are formed so that the opening formed between the retention arms 209*e* is sufficiently large to provide space to enable the end of the shaft portion 702*b* of the trigger structure 702 retained by the retention arms 209*e* to rotate as shown in FIG. 9B. Similarly, the opening in the trigger housing 209*b* through which the print media contact portion 702*a* extends is made sufficiently large to enable the print media contact portion 702*a* to rotate as shown in FIG. 9B.

Various embodiments of the invention have been described. The descriptions are intended to be illustrative, not limitative. Thus, it will be apparent to one skilled in the art that certain modifications may be made to the invention as described above without departing from the scope of the claims set out below.

We claim:

1. A method for guiding movement of a print medium in proximity to a print drive mechanism used to advance a print medium through a print zone during a printing operation, comprising the steps of:

positioning a media guide located proximate to the print drive mechanism in a first position when the print drive mechanism is operated to advance a print medium over the media guide through the print zone during a printing operation, wherein the first position is specified to maintain a desired spacing within the print zone between the print medium and an apparatus for printing on the print medium; and positioning the media guide in a second position when a print medium is being fed over the media guide into the print drive mechanism, the second position being different than the first position, wherein the second position is specified to facilitate directing the leading edge of a print medium into the print drive mechanism.

2. A method as in claim 1, further comprising the step of securing the media guide into a position.

3. A method as in claim 1, further comprising the step of moving the media guide comprises means for rotating the media guide.

4. A method as in claim 1, further comprising the step of securing the media guide into the second position, and wherein the second position is a position at which the media guide has been rotated such that a media contact surface of the media guide is lower, relative to a feed math into the print drive mechanism, than at the first position.

5. A method as in claim 4, wherein an acute angle is formed between the angular orientations of the media guide in the first and second positions, and the acute angle is greater than about 5°.

6. A method as in claim 5, wherein an acute angle is formed between the angular orientations of the media guide in the first and second positions, and the acute angle is greater than about 10°.

7. A method as in claim 4, wherein an acute angle is formed between the angular orientations of the media guide in the first and second positions, and the acute angle is less than about 90°.

8. A method as in claim 7, wherein an acute angle is formed between the angular orientations of the media guide in the first and second positions, and the acute angle is less than about 45°.

9. A method as in claim 8, wherein an acute angle is formed between the angular orientations of the media guide in the first and second positions, and the acute angle is less than about 30°.

10. A method as in claim 4, wherein an acute angle is formed between the angular orientations of the media guide in the first and second positions, and the acute angle is about 18°.

11. Structure for use with a printer, comprising:

means for defining a print medium feed path; and a sensing system for sensing insertion of a print medium into the print medium feed path, the sensing system comprising:

a sensor that is adapted to perform a sensing function other than sensing insertion of a print medium into the print medium feed path, wherein, at times when insertion of a print medium into the print medium feed path is to be sensed, the sensor is adapted and/or positioned to sense the presence of an object in a space outside of the print medium feed path, and means for introducing an object into the space in response to insertion of a print medium into the print medium feed path.

12. Structure as in claim 11, wherein the means for introducing comprises:

means for contacting a print medium inserted into the print medium feed path; and means for moving the object into the space in response to contact with a print medium by the means for contacting.

13. Structure as in claim 12, wherein:

the means for contacting moves in response to a contact with a print medium; and the means for moving is connected to the means for contacting such that the means for moving moves in response to movement of the means for contacting, thereby moving the object into the space.

14. Structure as in claim 12, wherein the means for contacting produces an electrical signal in response to contact with a print medium, the structure further comprising means for transmitting the electrical signal to the means for moving, wherein the means for moving moves the object into the space in response to the electrical signal.

15. Structure as in claim 11, wherein the sensor is positioned on a print carriage of a printer with which the structure is used.

16. Structure for use with a printer, comprising:

means for defining a print medium feed path; and a sensing system for sensing insertion of a print medium into the print medium feed path, the sensing system comprising a sensor for detecting insertion of a print medium into the print medium feed path and for performing a sensing function that can be distinguished from detecting insertion of a print medium into the print medium feed path, wherein the sensor is adapted to sense the presence of a print medium in a defined space.

17. Structure for use with a printer, comprising:

means for defining a print medium feed path; and a sensing system for sensing insertion of a print medium into the print medium feed path, the sensing system comprising a sensor for detecting insertion of a print medium into the print medium feed path and for performing a sensing function that can be distinguished from detecting insertion of a print medium into the print medium feed path, wherein the sensor is a reflective sensor.

18. Structure for use with a printer, comprising:

means for defining a print medium feed path; and a sensing system for sensing insertion of a print medium into the print medium feed path, the sensing system comprising:

a sensor for detecting insertion of a print medium into the print medium feed path and for performing a sensing function that can be distinguished from detecting insertion of a print medium into the print medium feed path;

a rotatably mounted trigger structure including a print media contact portion positioned within the print medium feed path such that a print medium inserted into the print medium feed path contacts the print media contact portion of the trigger structure, the trigger structure rotating so that the print media contact portion of the trigger structure moves out of the way of the print medium as the print medium is inserted further into the print medium feed path after contact of the print medium with the print media contact portion of the trigger structure; and a trigger flag coupled to the trigger structure, wherein rotation of the trigger structure as a print medium is inserted into the print medium feed path causes the trigger flag to move from a first position in which the presence of the trigger flag cannot be sensed by the sensor to a second position in which the presence of the trigger flag can be sensed by the sensor.

19. Structure as in claim 18, further comprising a trigger flag housing within which the trigger flag is positioned when the trigger flag is in the first position.

20. Structure for use with a printer, comprising:

means for defining a print medium feed path;

means for contacting a print medium inserted into the print medium feed path to enable sensing of the presence of the print medium in the print medium feed path; and means for compliantly supporting the means for contacting, such that when a print medium in contact with the means for contacting is moved in a direction opposite that in which the print medium was inserted into the print medium feed path, the means for contacting can be moved in response to a force exerted by the print medium.

21. Structure as in claim 20, wherein:

the means for contacting further comprises a trigger structure rotatably supported proximate to the print medium feed path, the trigger structure further comprising a print media contact portion extending into the print medium feed path, wherein insertion of the print medium into the print medium feed path moves the print media contact portion so that the trigger structure rotates to allow the print medium to pass by the print media contact portion, the print media contact portion remaining in contact with a surface of the print medium; and the means for compliantly supporting further comprises a spring positioned adjacent the trigger structure that allows the trigger structure to move in a direction normal to a surface of the print medium.

22. Structure for use with a printer, comprising:

means for defining a print medium feed path, wherein the print medium feed path is adapted to enable manual insertion of a print medium into the print medium feed path;

a sensing system for sensing insertion of a print medium into the print medium feed path, the sensing system comprising a sensor for detecting insertion of a print medium into the print medium feed path and for performing a sensing function that can be distinguished from detecting insertion of a print medium into the print medium feed path; and means for defining a second print medium feed path, wherein a print medium is fed through the first print medium feed path to a drive roller in a first direction that is different from a second direction in which a print medium is fed through the second print medium feed path to the drive roller.

23. Structure as in claim 22, wherein the first direction is substantially opposite to the second direction.

24. Structure as in claim 22, wherein the second print medium feed path is adapted to enable automatic insertion of a print medium into the second print medium feed path.

25. A method for sensing insertion of a print medium into a print medium feed path, comprising the steps of:

introducing an object into a space outside of the print medium feed path in response to insertion of a print medium into the print medium feed path; and activating a sensor such that the sensor senses the presence of an object in the space outside of the print medium feed path, wherein the sensor is adapted to perform a sensing function other than sensing insertion of a print medium into the print medium feed path.

26. A method as in claim 25, further comprising the step of positioning an object at least partially in the print medium feed path so that the object will contact a print medium inserted into the print medium feed path, wherein the step of introducing is performed in response to contact between the object and a print medium inserted into the print medium feed path.

27. A method as in claim 25, further comprising the step of positioning the sensor on a print carriage of a printer in which the print medium feed path is defined.

28. A method as in claim 25, wherein the print medium feed path is adapted for manual insertion of a print medium.

29. Structure as in claim 11, wherein the sensor is adapted to sense the position of a print medium that has passed at least partially through a print zone of the printer.

30. Structure as in claim 29, wherein the means for defining a print medium feed path defines the print medium feed path such that a print medium is fed through the print medium feed path to a drive roller in a first direction that is different from a second direction in which the print medium moves from the drive roller through the print zone during a printing operation.

31. Structure as in claim 11, wherein the print medium feed path is adapted to enable manual insertion of a print medium into the print medium feed path.

32. Structure as in claim 31, wherein the first direction is substantially opposite to the second direction.

* * * * *